United States Patent [19]

Bartkowicz

[11] Patent Number: 5,011,145

[45] Date of Patent: Apr. 30, 1991

[54] BASEBALL BAT WITH ROTARY GRIP

[76] Inventor: Robert J. Bartkowicz, 3 Canal St., Sayreville, N.J. 08872

[21] Appl. No.: 93,243

[22] Filed: Sep. 4, 1987

[51] Int. Cl.[5] ..... A63B 59/06

[52] U.S. Cl. ..... 273/72 R; 273/72 A; 273/26 B

[58] Field of Search ..... 273/67 A, 72 R, 72 A, 273/81 R, 81 L, 193 B, 26 B

[56] References Cited

U.S. PATENT DOCUMENTS

| | | | |
|---|---|---|---|
| 1,305,952 | 6/1919 | Suesman | 273/81 L |
| 2,091,458 | 8/1937 | Sleight | 273/72 R |
| 2,225,839 | 12/1940 | Moore, Jr. | 273/81 C |
| 2,471,610 | 5/1949 | Christensen | 273/72 R |
| 2,659,605 | 11/1953 | Tourneau | 273/72 R |
| 3,236,521 | 2/1966 | Knott | 273/72 R |
| 3,469,839 | 9/1969 | Pietronato | 273/72 R |
| 3,623,724 | 11/1971 | Lande | 273/72 R |
| 3,804,413 | 4/1974 | Hrivnak | 273/81 C |
| 3,834,714 | 9/1974 | Smolinski | 273/81 L |
| 4,012,039 | 3/1977 | Yerke | 273/81 R |

*Primary Examiner*—Edward M. Coven
*Assistant Examiner*—Mark S. Graham
*Attorney, Agent, or Firm*—Arthur L. Lessler

[57] ABSTRACT

A baseball bat having a handle adjacent an end of the bat. An upper hand grip is rotatably mounted on the handle to allow a more natural swing than is available with conventional fixed-grip arrangements. A fixed lower hand grip acts as a spacer for positioning the upper hand grip a desired distance from the end of the bat. The upper hand grip has an inner sleeve with a low friction inner surface permitting rotation of the inner sleeve on the baseball bat handle, and a resilient outer sheath for urging the inner sleeve against the bat handle.

14 Claims, 1 Drawing Sheet

BASEBALL BAT WITH ROTARY GRIP

BACKGROUND OF THE INVENTION

This application relates to an improved baseball bat, and more particularly to a baseball bat especially suitable for use by adults, teenagers and children for training purposes and for use by teenagers and children for playing purposes.

Various types of baseball bat grips are known in the art. Such grips are designed to prevent slipping of the hands on the bat, so that there is no movement of the hands with respect to the bat handle as the bat is swung. See, for example, U.S. Pat. Nos. 3,623,724; 3,469,839; 3,236,521; and 2,091,458.

An object of the present invention is to provide a bat handle with a grip which permits a more natural movement of the arms and shoulders than do prior art grips, when the bat is swung.

SUMMARY OF THE INVENTION

As herein described, according to one aspect of the invention there is provided a baseball bat having a handle adjacent an end of the bat. An upper hand grip is rotatably mounted on the handle. Spacer means is provided for positioning the hand grip a predetermined distance from the end of the bat.

According to another aspect of the invention, there is provided an upper hand grip for a baseball bat having a handle adjacent an end of the bat. The upper hand grip comprises an inner sleeve having a low friction inner surface permitting rotation of said inner sleeve on said baseball bat handle, and a resilient outer sheath for urging the inner sleeve against the bat handle. A spacer means is provided for positioning the hand grip a predetermined distance from the end of the bat.

IN THE DRAWING

DETAILED DESCRIPTION

Figure 1:
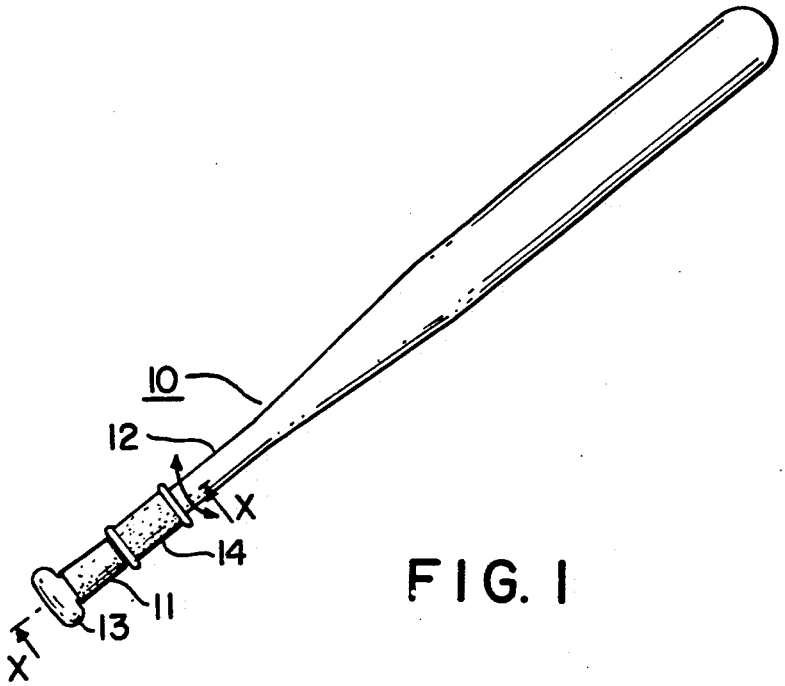
FIG. 1 is an elevation view of a baseball bat with a grip arrangement according to a preferred embodiment of the present invention.

As shown in FIG. 1, a wood, metal or plastic otherwise conventional baseball bat 10 has a spacer means comprising a lower hand grip 11 which is adherent to the portion of the bat handle 12 which is closest to the handle end 13.

A rotatable upper hand grip 14 surrounds the bat handle 12 in a region adjacent the lower (non-rotatable) hand grip 11 and further away from the handle end 13; so that the hand grip 11 insures that the hand grip 14 is spaced apart from the handle end by at least a predetermined distance corresponding to the width of the grip 11.

The lower hand grip 11 preferably comprises a resilient rubber sheath which is initially of smaller diameter than the portion of the bat handle 12 on which it is to be installed. The sheath is stretched so that it can pass over the handle end 13 and thereupon released, so that the sheath tightly grips the portion of the handle 12 adjacent the handle end 13.

The lower hand grip 11 preferably has a non-slip outer surface suitable for gripping purposes, and a length on the order of four inches for most applications. Shorter lengths can be employed for bats which are to be used by children.

The rotatable upper hand grip 14 comprises an inner sleeve 15 and an outer sheath 16. The inner sleeve 15 comprises a sheet of a material such as polytetrafluoroethylene (sold under the trademark Teflon) having a low friction surface, said sheet being wrapped around the bat handle 12 so that the sleeve 15 is easily rotatable about the bat handle.

The outer sheath 16 comprises a resilient rubber sheath which is initially of smaller diameter than the inner sleeve 15 (i.e. essentially of smaller diameter that the adjacent portion of the bat handle 12, since the thickness of the sleeve 15 is relatively small) over which it is to be installed. The sheath 16 is stretched so that it can pass over the handle end 13, positioned over the inner sleeve 15, and thereupon released, so that the sheath 16 tightly grips the outer surface of the inner sleeve 15 and presses is against the adjacent outer surface of the bat handle 12, to cause the inner sleeve 15 and outer sheath 16 to be rotatable as a unit on the bat handle 12.

The outer sheath 16 of the rotatable upper hand grip 14 preferably has a non-slip outer surface suitable for gripping purposes, and a length on the order of four inches for most applications. Shorter lengths can be employed for bats which are to be used by children.

Figure 2:
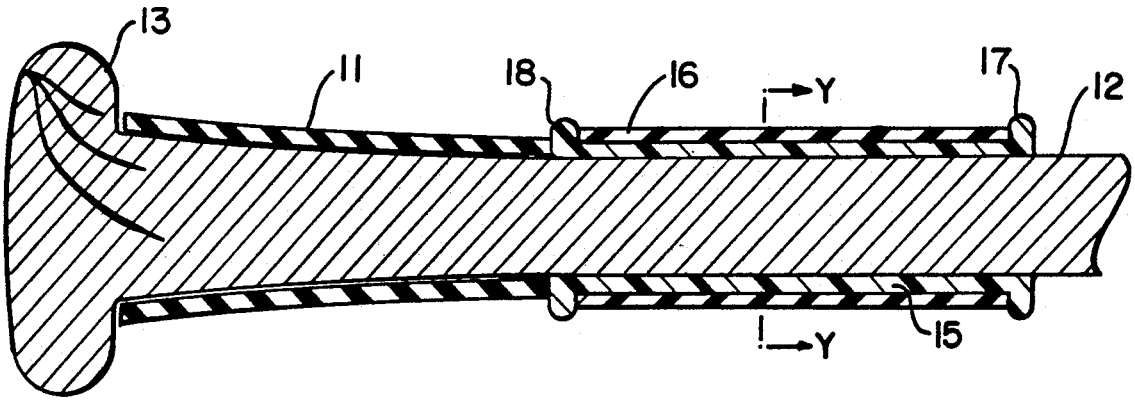
FIG. 2 is a side cross-sectional view of the handle portion of the bat, taken along the cutting plane X—X shown in FIG. 1.
Figure 3:
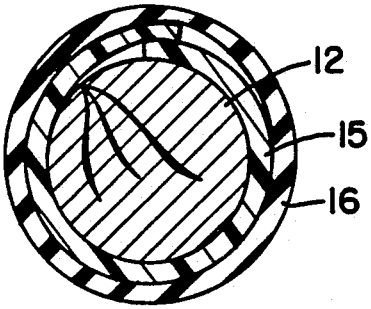
FIG. 3 is a cross-sectional view of the rotary grip of the bat, taken along the cutting plane Y—Y shown in FIG. 2.

As seen in FIG. 2, the upper and lower edges of the inner sleeve 15 are thicker than the rest of the sleeve, so that said edges form an upper flange 17 and a lower flange 18. These flanges preferably have a radially extending dimension greater than the thickness of the outer sheath 16, so that the flanges 17 and 18 cooperate with the rest of the sleeve 15 to form a circumferential recess in which the outer sheath 16 is disposed. Thus in effect the inner sleeve 15 and its thickened portions 17 comprise a spool for receiving the outer sheath 16.

The inner sleeve 15 preferably has a thickness on the order of 0.032 inches and flanges which extend a distance on the order of 0.125 inches beyond the outer surface of the inner sleeve. The sheaths 11 and 16 preferably also have a thickness on the order of 0.032 inches.

Rather than forming the flanges 17 and 18 as integral parts of the inner sleeve 15, these flanges can be formed as separate members. For example, they can constitute resilient upper and lower O-rings which tightly grip the bat handle 12, with the rotary grip 14 (i.e. the inner sleeve 15 and outer sheath 16) being rotatable on the portion of the bat handle 12 disposed between the O-rings.

The flanges 17 and 18 need not be continuous, but may if desired comprise a series of radially outwardly extending flange sections.

The lower hand grip grip 11 acts as a spacer means to prevent the lower flange 18 of the rotatable upper hand grip 14 from being positioned too close to the bat handle end 13. Such positioning is accomplished by abutment of the lower surface of the flange 18 with the upper edge of the lower hand grip 11. Alternatively, another form of spacer means such as a shoulder or ridge formed on or affixed to the bat handle adjacent the lower flange 18 may be employed.

If the flange 18 is replaced by an O-ring which tightly grips the bat handle 12, the O-ring itself acts as the spacer means; and the lower hand grip is not required for that purpose and can if desired be dispensed with.

When the bat is swung, the rotational movement or "breaking" of the wrist of the upper hand in the course of a normal swing causes the rotatable upper grip 14 to turn on the bat handle 12, thus permitting a natural wrist movement and a more powerful swing than can be obtained with a conventional bat where the tendency of the wrist of the upper hand to rotate is suppressed and necessarily compensated for by forced accentuated movement of the arm and shoulder coupled to the upper hand. Thus the grip arrangement of the present invention permits a more natural swing than can be obtained with conventional baseball bats and grips.

I claim:

1. A baseball bat having a non-rotatable handle adjacent an end of the bat, an upper hand grip rotatably mounted on the handle, and spacer means for positioning said hand grip a predetermined distance from said end of said bat, said predetermined distance being sufficiently great to permit grasping of the handle by one hand between the end of the bat and the upper hand grip.

2. The bat according to claim 1, wherein said spacer means comprises a non-rotatable lower hand grip mounted on said handle adjacent said end of said bat.

3. The bat according to claim 1, wherein said upper hand grip comprises an inner sleeve having a low friction inner surface, and a resilient outer sheath for urging said inner sleeve against said bat handle.

4. The bat according to claim 3, further comprising flange means for preventing longitudinal movement of said outer sheath with respect to said inner sleeve.

5. The bat according to claim 4, wherein said flange means is integral with said inner sleeve.

6. The bat according to claim 5, wherein said inner sleeve comprises polytetrafluoroethylene.

7. A baseball bat having a handle adjacent an end of the bat, comprising:

an upper hand grip rotatably mounted on the handle, said upper hand grip comprising an inner sleeve having a low friction inner surface and a resilient outer sheath for urging said inner sleeve against said bat handle; and spacer means comprising a non-rotatable lower hand grip mounted on said handle adjacent said end of said bat for positioning said upper hand grip a predetermined distance from said end of said bat.

8. The bat according to claim 7, further comprising means for preventing longitudinal movement of said outer sheath with respect to said inner sleeve.

9. The bat according to claim 8, wherein said preventing means comprises flange means integral with said inner sleeve.

10. The bat according to claim 9, wherein said inner sleeve comprises polytetrafluoroethylene.

11. In combination, a baseball bat having a handle adjacent an end of the bat and an upper hand grip for said bat, comprising:

an inner sleeve having a low friction inner surface permitting rotation of said inner sleeve on said baseball bat handle;

a resilient outer sheath for urging said inner sleeve against said bat handle; and spacer means for positioning sad hand grip a predetermined distance from said end of said bat.

12. The upper hand grip according to claim 11, further comprising means for preventing longitudinal movement of said outer sheath with respect to said inner sleeve.

13. The bat according to claim 11, wherein said preventing means comprises flange means integral with said inner sleeve.

14. The bat according to claim 12, wherein said inner sleeve comprises polytetrafluoroethylene.

* * * * *